US005294513A

United States Patent [19]

Mitchell et al.

[11] Patent Number: 5,294,513

[45] Date of Patent: Mar. 15, 1994

[54] ENCAPSULATED ELECTROSTATOGRAPHIC TONER PARTICLES AND A PROCESS FOR PRODUCING SUCH TONERS

[75] Inventors: Nancy G. Mitchell, Grand Island; Gary R. Wilger, Tonawanda, both of N.Y.

[73] Assignee: Moore Business Forms, Inc., Grand Island, N.Y.

[21] Appl. No.: 829,588

[22] Filed: Feb. 3, 1992

Related U.S. Application Data

[63] Continuation of Ser. No. 344,690, Apr. 28, 1989, abandoned.

[51] Int. Cl.[5] ..... G03G 9/00; G03G 5/00; G03C 1/72

[52] U.S. Cl. ..... 430/109; 430/138; 430/137

[58] Field of Search ..... 430/109, 138

[56] References Cited

U.S. PATENT DOCUMENTS

| | | | |
|---|---|---|---|
| 3,080,251 | 3/1958 | Claus | 430/138 X |
| 4,307,169 | 12/1981 | Matkan | 430/138 X |
| 4,533,617 | 8/1985 | Inoue et al. | 430/138 X |
| 4,642,281 | 2/1987 | Kakimi et al. | 430/138 |
| 4,727,011 | 2/1988 | Mahabadi et al. | 430/138 |
| 4,740,443 | 4/1988 | Nakahara et al. | 430/106.6 |
| 4,761,358 | 8/1988 | Hosoi et al. | 430/109 |
| 4,766,051 | 8/1988 | Breton et al. | 430/138 |
| 4,803,144 | 2/1989 | Hosoi | 430/106.6 |
| 4,814,253 | 3/1989 | Gruber et al. | 430/106.6 |
| 4,869,990 | 9/1989 | Hosoi | 430/110 |
| 4,973,541 | 11/1990 | Kohri et al. | 430/111 |
| 4,977,052 | 12/1990 | Mikami | 430/111 |

OTHER PUBLICATIONS

Billmeyer, Fred W., *Textbook of Polymer Science*, 1984, p. 27.

*Primary Examiner*—Marion E. McCamish
*Assistant Examiner*—Stephen Crossan
*Attorney, Agent, or Firm*—Finnegan, Henderson, Farabow, Garrett & Dunner

[57] ABSTRACT

Encapsulated electrostatographic toner particles and a process for making toner particles. The toner particles comprise a pressure fixable core encapsulated in a pressure rupturable shell with the outer surface of the shell being hydrophobic. Preferably, the outer surface of the shell is rendered hydrophobic by having a thermosetting resin precipitated thereon. The process for producing electrostatographic toner particles comprises preparing a core material, encapsulating a discrete portion of the core material in a shell by interfacial polycondensation, and then treating the outer surfaces of the shells with a thermosetting resin to render them hydrophobic. This enables the particles to be formed as a free-flowing, dry powder without requiring costly spray drying.

11 Claims, No Drawings

ENCAPSULATED ELECTROSTATOGRAPHIC TONER PARTICLES AND A PROCESS FOR PRODUCING SUCH TONERS

This application is a continuation of application Ser. No. 07/344,690, filed Apr. 28, 1989, now abandoned.

BACKGROUND OF THE INVENTION

The present invention relates to encapsulated electrostatographic toners and, more particularly, to an electrostatographic toner material which comprises a pressure fixable core encapsulated in a pressure rupturable shell with the outer surface of the shell being hydrophobic. Preferably, the outer surface of the shell is rendered hydrophobic by precipitating at least one thermosetting resin onto the pressure rupturable shell. The present invention also relates to a process for preparing an encapsulated electrostatographic toner material.

Electrostatography involves developing a tone electrostatic latent image contained on a photoconductive or dielectric surface with a toner material containing a colorant and a binder to produce a visible toner image, and then transferring and fixing the visible toner image onto a surface such as a paper sheet. The development of the latent image utilizes either a combination of a toner material with carrier particles or a toner material only. The process for fixing the toner image to the paper sheet can be accomplished by heat fixing, solvent fixing or pressure fixing.

Encapsulated electrostatographic toner materials for use in pressure fixing are well-known, as disclosed by, for instance, U.S. Pat. No. 4,307,169 which discloses production of such toners by interfacial polymerization. In this prior art process, it has been necessary to spray dry the resulting slurry of particles to produce a free-flowing, dry powder. Obtaining a toner material in the form of a free-flowing, dry powder is desirable to permit easy handling of the toner.

However, the spray drying process suffers from the disadvantages that it can require costly spray drying equipment, can consume a large quantity of energy and can also restrict the potential use of heat sensitive or volatile components in the core material of the toner. Therefore, there has been a need for a process of producing encapsulated toner materials in the form of a dry, free-flowing powder that does not require spray drying.

Various attempts have been made to produce dry, free-flowing encapsulated toner particles by interfacial polymerization without spray drying. The inventor has attempted to obtain toner particles in the form of a dry powder by filtering, by air drying and by oven drying the slurry of capsules; however, such attempts have been unsuccessful due to the tendency for the capsules to cake and agglomerate. Up to now, spray drying has been necessary to keep the particles separated during the drying process.

It is therefore an object of the present invention to provide an improved encapsulated toner material that overcomes the disadvantages of the prior art.

It is another object of the present invention to produce electrostatographic toner particles by interfacial polymerization that are in the form of a dry, free-flowing powder.

It is another object of the present invention to produce encapsulated electrostatographic toner particles by interfacial polymerization without the necessity of spray drying the particles produced.

It is another object of the present invention to minimize the caking or agglomerating of capsules during the process for producing an encapsulated electrostatographic toner material.

It is another object of the present invention to provide an energy efficient process for producing dry, free-flowing electrostatographic toner particles by interfacial polymerization.

It is a further object of the present invention to provide encapsulated electrostatographic toner materials capable of containing volatile or heat sensitive core materials.

SUMMARY OF THE INVENTION

The present invention, as embodied and broadly described herein, overcomes the problems and disadvantages of the prior art and achieves the aforementioned objects in accordance with the purpose of the invention by providing an encapsulated electrostatographic toner material comprising a pressure fixable core encapsulated in a pressure rupturable shell, the outer surface of the shell being hydrophobic. The shell material is produced by interfacial polymerization and the outer surface of the shell is preferably rendered hydrophobic by depositing or coating at least one thermosetting resin onto the shell outer surface. This thermosetting resin is preferably urea-formaldehyde, melamine-formaldehyde, resorcinol-formaldehyde, alkyd, acrylic, amino, phenolic, unsaturated polyester, epoxy, polyurethane or acrylic copolymer.

In another aspect of the invention, as embodied and broadly described herein, there is provided a process for preparing dry, free-flowing encapsulated electrostatographic toner particles which comprises preparing a core material, encapsulating discrete portions of the core material in shells by interfacial polymerization of reactive components in an aqueous dispersion, and subjecting the outer surfaces of the shells to a treatment to render the shells hydrophobic. It is preferred to precipitate at least one thermosetting resin onto the outer surfaces of the shells to render them hydrophobic.

DETAILED DESCRIPTION OF THE PREFERRED EMBODIMENTS

Reference will now be made in detail to the presently preferred embodiments of the invention.

In accordance with the present invention, an encapsulated electrostatographic toner material is produced by an interfacial polymerization process such as is disclosed by U.S. Pat. No. 4,307,169 to Matkan, which is incorporated herein by reference in its entirety. Briefly, the technique disclosed in the Matkan patent to encapsulate a pressure fixable core material comprises a process in which a non-aqueous phase core material containing one reacting material is emulsified in an aqueous phase containing a second reacting material. Reaction is arranged to occur under constant agitation to produce microdroplets of the non-aqueous phase core material encapsulated in a shell comprising the reaction product formed at the phase interface, such shell preferably comprising a substantially impervious polymeric compound.

In a dry, free-flowing powder of micro-encapsulated particles, the process disclosed by U.S. Pat. No. 4,307,169 utilizes a method of spray drying the particles. Spray drying can require capital expenditures in the order of approximately $1,000,000 for the purchase of spray drying equipment and also can require a high consumption of energy since large amounts of water must be driven off to dry the particles. In addition, spray drying can also restrict the potential use of heat sensitive or volatile components in the core material of the toner.

In accordance with the present invention, an encapsulated electrostatographic toner material is produced that is in the form of a dry, free-flowing powder, without the necessity of spray drying. The dry, free-flowing particles of the present invention are obtained by rendering the shell outer surfaces hydrophobic by depositing or coating at least one thermosetting resin onto the outer surface of the shell particles.

In accordance with the invention, the thermosetting resin deposited or coated onto the outer surface of the shell particles is preferably initially soluble or dispersible in water. The thermosetting resin is preferably precipitated onto the shell surface by a precipitation reaction initiated by heat, pH, catalyst or by a combination thereof.

The thermosetting resin deposited or coated onto the outer surface of the shell in the present invention is preferably urea-formaldehyde, melamine-formaldehyde, resorcinol-formaldehyde, alkyd, acrylic, amino, phenolic, unsaturated polyester, epoxy, polyurethane or acrylic copolymer. The preferred shell material for the electrostatographic toner material of the invention is polyurea, although numerous other polymer shell materials could be used, such as polyamide, polysulfonamide, epoxy or urea-formaldehyde, for example. In addition to the thermosetting resin or resins applied onto the outer surface of the shell, the shell outer surface may also contain any of a flow agent, conductive agent, polarity control agent and/or release agent bound to the surface thereof.

In accordance with the present invention, the composition of the pressure fixable core of the toner material may vary considerably but preferably comprises a colorant and a binder. The colorant generally is a dye or pigment and is selected from a variety of dyes or pigments known in the electrostatographic copying and duplicating art.

Generally, the colorant is a black or chromatic toner. The black toner may be, for example, carbon black. Examples of chromatic toners include blue colorants such as copper phthalocyanine and a sulfonamide derivative dye; yellow colorants such as a benzidine derivative dye, commonly called Diazo Yellow; and red colorants such as a double salt of xanthine dye with phosphorous wolframate and molybdate (Rhodamine B Lake), Carmine 6 B which is an Azo pigment or a quinacridone derivative.

In accordance with the invention, the binder included in the pressure fixable core along with the colorant is preferably a resin which may include the following: polyolefin, olefin copolymer, polystyrene, styrene-butadiene copolymer, epoxy resin, polyester, a natural or synthetic rubber, poly(vinylpyrrolidone), polyamide, cumarone-indene copolymer, methyl vinyl ether-maleic anhydride copolymer, maleic acid-modified phenol resin, phenol-modified terpene resin, silicone resin, epoxy-modified phenol resin, amino resin, polyurethane elastomer, polyurea elastomer, homopolymer and copolymer of an acrylic acid ester, homopolymer and copolymer of a methacrylic acid ester, ethylene methacrylic acid copolymer, acrylic acid-long chain alkyl methacrylate copolymer oligomer, poly(vinyl acetate), and poly(vinyl chloride).

In accordance with the invention, the pressure fixable core of the toner material of the present invention also preferably includes a drying oil such as an unsaturated fatty acid. The drying oil undergoes oxidation and polymerization when the capsules are ruptured and the oil is exposed to air thus aiding in fixing of the core material to a substrate. Examples of drying oils that can be used in the present invention include linseed, tung, orticia, dehydrated castor, safflower, sunflower, soya bean and tall oils.

The pressure fixable core material in accordance with the present invention may also include oils and solvents used to modify viscosity, to dissolve polymers or resins and to enhance penetration into the substrate paper upon capsule rupture. Examples of such oils and solvents which may be used within the scope of the invention include saturated vegetable oils such as coconut and peanut oils, aliphatic hydrocarbon oils and solvents such as aliphatic and naphthenic petroleum distillates, and aromatic hydrocarbons and plasticizers such as phthalates, phosphates and citrates.

In accordance with the invention, the core material may also include various waxes which can be used to impart mar resistance, improve slip and to enhance compressibility and adhesion. Examples of such waxes that may be used within the scope of the invention include polyethylene, ethylene vinyl acetate, polytetrafluoroethylene, paraffin, olefins, chlorinated olefins, microcrystalline montan, carnauba, ceresin, beeswax, ouricury, candelilla and Japan wax.

In accordance with the invention, the core material may also include magnetizable particles or magnetic pigments. Examples of magnetizable particles include particles of a metal (e.g., cobalt, iron or nickel), an alloy or a metallic compound. A chromatic magnetizable powder, such as black magnetite, may be utilized and can serve as both a magnetizable particle and a colorant. Specific examples of other particles that can serve as magnetic pigments include triiron tetroxide ($Fe_3O_4$), diiron trioxide ($Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Fine powders of these known magnetic substances can be used as the magnetic pigment singly or in combination.

Other additives which may be present in the core material in accordance with the invention include release agents, to promote release from fixing rolls, such as fatty acid amides and metal stearates, silicone oils, dispersing agents, and antioxidants such as naphthols, substituted phenols and oximes.

Other materials known in the art may also be present in the pressure fixable core in accordance with the invention.

In accordance with another aspect of the invention, a process is provided for preparing dry free-flowing encapsulated electrostatographic toner particles comprising preparing a core material, encapsulating discrete portions of the core material in shells created around the core material by interfacial polymerization of reactive components in an aqueous dispersion, and treating the outer surfaces of the shells by depositing at least one thermosetting resin thereon, to render the shells hydrophobic.

The interfacial polymerization process used to make the capsules in accordance with the invention and as described in U.S. Pat. No. 4,307,169 briefly comprises preparing an aqueous solution of an emulsion stabilizer, and dispersing a core material including an ink and a first reactive substance into the aqueous solution of an emulsion stabilizer to form an emulsion. An aqueous solution of a second reactive substance is then added to the emulsion under agitation until a polycondensation product forms as a shell at the interface between the emulsified droplets of the core material and the aqueous phase. This reaction between the first and second reactive substances thus forms a slurry of capsules, each capsule comprising a shell material surrounding a discrete portion, i.e., an emulsified droplet, of core material.

In accordance with the invention, the emulsion stabilizer used in the interfacial polymerization process preferably is polyvinyl alcohol. Prior to treatment of the shell surfaces to render them hydrophobic, a portion of the polyvinyl alcohol is preferably removed. This portion of polyvinyl alcohol may be removed by allowing the capsules to settle and then decanting the supernatant or by passing the capsule slurry through a magnetic separator and then collecting the solids.

The treatment of the outer surfaces of the shells with at least one thermosetting resin in accordance with the invention may be accomplished in one step or two depending upon the requirements of the final product. One method of treating the shell surfaces which can be accomplished in a single step is to add a thermosetting varnish to the capsule slurry followed by heating the slurry to a temperature and for a time sufficient to form a precipitate on the shell surfaces. It is preferred to heat the slurry to a temperature of 90°-200° F.

Materials that may be utilized as the thermosetting resin within the scope of the invention include Cymel 85 melamine-formaldehyde precondensate from American Cyanamid, W4252 formaldehyde-type lacquer along with W5058 catalyst both made by Selective Coatings and Inks, AWX1704 acrylic varnish available from Arcar Graphics, Arolon 820-W-49 acrylic varnish made by Spencer Kellogg, Arolon 585-W-43 modified alkyd varnish from Spencer Kellogg, Michem Prime 4990 ethylene acrylic varnish available from Michelman and Arolon 465-G4-80 unsaturated polyester made by Spencer Kellogg.

It is preferred to add a calcium stearate dispersion to the capsule slurry prior to heating to improve the free-flowing properties of the capsules. It is also preferred to add a conductive material to the capsule slurry prior to heating when the toner is to be used in certain printing or copying systems. The addition of the conductive material causes the capsules to shift from resistive to conductive. One such material is Black Shield 10795 conductive carbon dispersion available from CDI Dispersions. After the capsules are treated with the varnish, it is preferable to remove excess materials by magnetic separation.

In accordance with the invention, another method that can be used to treat the outer surfaces of the shells is to add a solution of a melamine-formaldehyde compound to the capsule slurry followed by heating the slurry to a temperature and for a time sufficient to form a precipitate on the surfaces of the shells. This will result in a free-flowing toner material.

It is preferred that the concentration of melamine-formaldehyde in the solution used to treat the shells range from 5-15%. It is also preferred that the slurry be heated to a temperature of 90°-200° F.

It has been found that some melamine-formaldehyde resins may not be suitable as binders for conductive additives since they interfere with surface conductivity. Therefore, if a conductive toner is desired, it may be necessary to attach conductive additives in a second step using a different binder such as a varnish. The varnish that may be utilized in this second treatment step includes W4252 varnish along with W5058 catalyst, AWX1704 varnish, or Arolon 820-W-49, Arolon 585-W-43, Michem Prime 4990 or Arolon 465-G4-80 varnishes. It is preferred that excess materials be removed by magnetic separation after both the treatment of the capsule slurry with melamine formaldehyde and again after treatment with the varnish.

After treatment of the surfaces of the capsule shells in accordance with the invention, the shells are preferably filtered, dried, and classified to the desired size range to result in a toner material that is a dry free-flowing powder.

The following examples further illustrate the present invention. The examples should in no way be considered limiting, but are merely illustrative of the various features of the present invention.

To carry out Examples 1-2, a core material or ink and shells encapsulating the core material were prepared according to the following procedure:

The ink was prepared according to the following formula using commercially available materials:

| Material | % by Weight |
|---|---|
| Krystallex 3085 hydrocarbon based on alpha methylstyrene (Hercules) | 23.9 |
| AC 430 ethylene vinyl acetate copolymer (Allied) | 2.9 |
| Flexol 4GO tetraethylene glycol di(2-ethyl hexoate) (Union Carbide) | 6.7 |
| Safflower Oil NB (PVO International) | 4.8 |
| Isopar M isoparaffinic solvent (Exxon) | 9.5 |
| Polydimethylsiloxane PS041 (Petrarch) | 2.4 |
| Mapico Black magnetite (Columbian) | 47.7 |
| Solsperse 3000 hyperdispersant (ICI) | 2.1 |

The oils (excluding polydimethylsiloxane) and resin were stirred in a heated tank (190° F.) using a Cowles blade until the resin melted. To this were added Solsperse, then the magnetite, then polydimethylsiloxane. The solution was then stirred 30 minutes at low speed. The capsules were prepared according to the following formula using the ink prepared above, water and commercially available materials:

| Solution | Material | % by Weight (Wet) |
|---|---|---|
| 1 | Ink | 30.12 |
| | Mondur XP744 aromatic polyisocyanate (Mobay) | 4.41 |
| 2 | Vinol 540 polyvinyl alcohol (Air Products) | 0.58 |
| | Water | 61.71 |
| 3 | Diethylene Triamine | 0.82 |
| | Water | 2.35 |

Solution 1 was emulsified into solution 2 to obtain droplets having a particle size of 5-100 microns. Solution 3 was then added and the mixture was heated to 120° F. for 30 minutes to form polyurea capsules. The capsule slurry was allowed to cool, diluted to 10% solids, and stirring was discontinued for 20 minutes. The capsules settled to the bottom and the supernatant containing excess polyvinyl alcohol was poured off. Dilution, settling and decanting procedures were repeated once.

Example 1

To 500 grams of the above capsule slurry (40% solids) was added, with stirring, 9 grams of 4252 varnish and 1 gram of W5058 catalyst (both from Selective Coatings and Inks), 10 grams of Michem 170 aqueous calcium stearate dispersion (Michelman) and 120 grams Black Shield 10795 conductive carbon dispersion (CDI Dispersions). The slurry was heated to 150° F. and held for 30 minutes to precipitate varnish, carbon and calcium stearate onto the capsule shells. The mixture was cooled, diluted to 10% solids and poured through an Eriez magnetic separator to remove unattached materials. The capsules were collected, filtered and dried at 80° C. for 1 hour. Particles larger than 90 microns were removed by sieving. The resultant toner powder was placed in the hopper of a Delphax 2460 printer. Dense images having excellent fuse quality were obtained.

Example 2

This Example was conducted in the same manner as Example 1, except 10 grams of AMX1704 varnish (Arcar Graphics) was used in place of the W4252/W5058 combination and the slurry was heated to 120° F. The results were the same, except that flowability of the toner was slightly inferior.

Examples 3–6

To carry out Examples 3–6, the core material or ink and shells encapsulating the core material were prepared according to the following procedure.

The ink was prepared according to the following formula using commercially available materials:

| Material | % by Weight |
|---|---|
| Krystallex 3085 | 23.9% |
| AC 430 | 2.9 |
| NB Safflower Oil | 5.7 |
| Flexol 4G0 | 4.8 |
| Isopar M | 5.7 |
| Mapico Black | 52.6 |
| PS041 | 3.0 |
| Solsperse 3000 | 1.4 |

The capsules were prepared according to the procedure and formulation previously described. The capsules were decanted two times. To 519 g of capsule slurry containing 259 g of capsule solids was added 155 g Black Shield carbon dispersion, 13 g Michem 170 and 15.6 g of each of the following varnishes:

Example 3—Arolon 820-W-49 (acrylic) (Spencer Kellogg)

Example 4—Arolon 585-W-43 (modified alkyd) (Spencer Kellogg)

Example 5—Michem Prime 4990 (ethylene acrylic) (Michelman)

Example 6—Arolon 465-G4-80 (unsaturated polyester) (Spencer Kellogg)

The slurries were heated to 150° F. for one hour and then allowed to cool. Solids of each sample were concentrated on the Eriez Separator, dried and sieved to remove particles above 45 microns. Each of samples 3–6 produced a dense image on the printer.

Example 7

A core material (ink) and shells encapsulating the core material were prepared by the following procedure using commercially available materials.

The ink was prepared according to the following formula:

| Material | % by Weight |
|---|---|
| Krystallex 3085 | 14.1% |
| AC430 | 9.4% |
| Safflower Oil | 4.7% |
| Flexol 4GO | 7.5% |
| Isopar M | 11.3% |
| PS041 | 3.0% |
| Mapico Black | 48.5% |
| Solsperse 3000 | 1.5% |

The procedure for preparing the ink was identical to that of Examples 1–6. The formula and procedure for preparing the capsules was the same as in Examples 1–6 except that rather than diluting, settling and decanting the capsules, the slurry was diluted to 10% solids and then passed through the magnetic separator.

To 352 grams of capsule slurry (18.7% solids) was added 87 grams of water and 4.11 grams of Cymel 85 melamine-formaldehyde precondensate (American Cyanamid). The pH was adjusted to 5 with p-toluenesulfonic acid and the mixture was heated to 150° F. and held at that temperature for 30 minutes. The mixture was cooled, 87 grams of water was added and the capsules were poured through the magnetic separator. The capsules were collected and then 344 grams of water, 7 grams of W4252 varnish, 0.8 gram of W5058 catalyst and 34 grams of Ti Tint XC72 conductive carbon dispersion (Technical Industries) were added.

The mixture was heated one hour at 140° F., then cooled, passed through the magnetic separator, and the capsules filtered. The capsules were dried at 80° C. for 1 hour and sieved to remove particles above 90 microns. The resultant toner was placed in the hopper of a Mita 900D. Dense images with excellent fuse quality were obtained.

Although the present invention has been described in connection with the preferred embodiments, it is understood that modifications and variations may be resorted to without departing from the spirit and scope of the invention. Such modifications are considered to be within the purview and scope of the invention and the appended claims.

What is claimed is:

1. A process for preparing dry free-flowing encapsulated electrostatographic toner particles without spray drying comprising:

preparing a pressure fixable core material containing a colorant, a binder and at least one oil;

encapsulating discrete portions of the core material in shells by interfacial polymerization of reactive components in an aqueous dispersion to form an aqueous slurry of microcapsules;

adding at least one thermosetting resin to said aqueous slurry of microcapsules;

precipitating said at least one thermosetting resin onto said microcapsule shell outer surfaces to render said microcapsules hydrophobic;

filtering said microcapsules; and heating said microcapsules, without spray drying, to a temperature and for a time sufficient to dry said microcapsules.

2. The process of claim 1, wherein said encapsulation by interfacial polymerization comprises:

preparing an aqueous solution of an emulsion stabilizer;

dispersing the core material including a first reactive substance into said aqueous solution to form an emulsion; and adding an aqueous solution of a second reactive substance to said emulsion under agitation to form a polycondensation product as a shell at the interface between the emulsified droplets of the core material and the aqueous phase by reaction between said first and second reactive substances, thereby forming a slurry of capsules, each containing said core material encapsulated in said shell.

3. The process of claim 2, wherein said emulsion stabilizer is polyvinyl alcohol.

4. The process of claim 3, further comprising removing a portion of said polyvinyl alcohol prior to treatment of the shell outer surfaces.

5. The process of claim 2, wherein said first reactive substance is an aromatic polyisocyanate and said second reactive substance is diethylene triamine.

6. The process of claim 5, wherein said shell is polyurea.

7. The process of claim 2, wherein said treatment comprises:

adding a varnish to said slurry of capsules followed by heating to a temperature and for a time sufficient to form a precipitate on said shell outer surfaces.

8. The process of claim 7, further comprising adding to said capsule slurry prior to heating, materials selected from among calcium stearate, a conductive agent, a polarity control agent, and a catalyst.

9. The process of claim 2, wherein said treatment comprises:

adding a solution of a melamine-formaldehyde compound to said slurry of capsules followed by heating to a temperature and for a time sufficient to form a precipitate on the outer surfaces of said shells.

10. The process of claim 9, further comprising adding a varnish to said slurry of capsules after formation of said precipitate followed by heating to a temperature and for a time sufficient to form a further precipitate on the outer surfaces of said shells.

11. The process of claim 10, further comprising adding to said slurry of capsules prior to heating, materials selected from among calcium stearate, a conductive agent, a polarity control agent and a catalyst.

* * * * *